US007114482B2

(12) United States Patent
Lane

(10) Patent No.: US 7,114,482 B2
(45) Date of Patent: Oct. 3, 2006

(54) ENGINE LUBRICATION CIRCUIT INCLUDING TWO PUMPS

(75) Inventor: William H. Lane, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 159 days.

(21) Appl. No.: 10/419,550

(22) Filed: Apr. 21, 2003

(65) Prior Publication Data

US 2004/0187833 A1 Sep. 30, 2004

Related U.S. Application Data

(60) Provisional application No. 60/458,461, filed on Mar. 28, 2003.

(51) Int. Cl.
*F01M 1/00* (2006.01)

(52) U.S. Cl. ..... 123/196 R

(58) Field of Classification Search ..... 123/196 R, 123/196 S; 184/27.2
See application file for complete search history.

(56) References Cited

U.S. PATENT DOCUMENTS

| | | | | |
|---|---|---|---|---|
| 2,838,039 | A | 6/1958 | Smith | |
| 4,458,644 | A | 7/1984 | Papst | |
| 4,512,298 | A * | 4/1985 | Hayashi | 123/196 R |
| 4,531,485 | A * | 7/1985 | Murther | 123/196 S |
| 4,642,604 | A | 2/1987 | Glesmann et al. | |
| 4,741,304 | A | 5/1988 | Martin et al. | |
| 5,063,895 | A * | 11/1991 | Ampferer | 123/196 R |
| 5,085,181 | A | 2/1992 | Feuling | |
| 5,121,720 | A | 6/1992 | Roberts | |
| 5,168,845 | A | 12/1992 | Peaker | |
| 5,247,914 | A | 9/1993 | Imai et al. | |
| 5,390,635 | A * | 2/1995 | Kidera et al. | 123/196 R |
| 5,511,522 | A | 4/1996 | Tran | |
| 5,597,051 | A * | 1/1997 | Moriya et al. | 184/6.1 |
| 5,743,231 | A | 4/1998 | Reinosa | |
| 5,765,521 | A | 6/1998 | Stutzle et al. | |
| 5,816,212 | A * | 10/1998 | Lindquist et al. | 123/196 R |
| 5,845,756 | A | 12/1998 | Dairokuno et al. | |
| 5,884,601 | A | 3/1999 | Robinson | |
| 5,894,825 | A * | 4/1999 | Duerr | 123/196 S |
| 5,901,811 | A | 5/1999 | Samples et al. | |
| 6,293,233 | B1 * | 9/2001 | Hiraoka | 123/73 AD |
| 6,305,342 | B1 * | 10/2001 | Narita et al. | 123/196 R |

(Continued)

*Primary Examiner*—Mahmoud Gimie
*Assistant Examiner*—Jason Benton
(74) *Attorney, Agent, or Firm*—Liell & McNeil

(57) ABSTRACT

A lubrication pump coupled to the engine is sized such that the it can supply the engine with a predetermined flow volume as soon as the engine reaches a peak torque engine speed. In engines that operate predominately at speeds above the peak torque engine speed, the lubrication pump is often producing lubrication fluid in excess of the predetermined flow volume that is bypassed back to a lubrication fluid source. This arguably results in wasted power. In order to more efficiently lubricate an engine, a lubrication circuit includes a lubrication pump and a variable delivery pump. The lubrication pump is operably coupled to the engine, and the variable delivery pump is in communication with a pump output controller that is operable to vary a lubrication fluid output from the variable delivery pump as a function of at least one of engine speed and lubrication flow volume or system pressure. Thus, the lubrication pump can be sized to produce the predetermined flow volume at a speed range at which the engine predominately operates while the variable delivery pump can supplement lubrication fluid delivery from the lubrication pump at engine speeds below the predominant engine speed range.

20 Claims, 2 Drawing Sheets

U.S. PATENT DOCUMENTS 6,443,263 B1 * 9/2002 Ito et al. ..... 184/6.5

6,739,305 B1 * 5/2004 Takahara et al. ..... 123/196 R

* cited by examiner

ENGINE LUBRICATION CIRCUIT INCLUDING TWO PUMPS

RELATION TO OTHER PATENT APPLICATION

This application claims the benefit of provisional patent application 60/458,461, filed Mar. 28, 2003 with the same title.

GOVERNMENT RIGHTS

This invention was made with Government support under DOE Contract No. DE-FC04-2000AL67017 awarded by the U.S. Department of Energy. The Government has certain rights to this invention.

TECHNICAL FIELD

The present invention relates generally to engine lubrication circuits, and more specifically to a method of lubricating an engine over an engine operating range, at least in part, by using a combination of two pumps.

BACKGROUND

In order for an engine to properly operate, lubrication fluid, such as oil, must be continuously delivered through a lubrication circuit of the engine.

The lubrication fluid lubricates and cools the engine's moving parts. Often, the lubrication fluid is delivered to the engine via a lubrication pump that is operably coupled to the engine. Thus, because the delivery of the lubrication fluid to the engine from the lubrication pump is dependent on the engine speed, the delivery of the lubrication fluid will increase as the engine speed increases.

However, the volume of lubrication fluid the engine requires generally increases with engine speed only until the engine reaches a speed at which the engine is operating at peak torque. At the peak torque engine speed, the volume of lubrication fluid the engine requires is approximately equal to a predetermined flow volume. Engineers have found that, at speeds faster than peak torque engine speed, the engine continues to require the predetermined flow volume of lubrication fluid regardless of whether the engine speed continues to increase. Thus, although the production of lubrication fluid may continue to increase with increased engine speed, the volume of lubrication fluid required to lubricate and cool the engine remains relatively constant when the engine is operating at speeds greater than the peak torque engine speed.

In order assure that the engine is sufficiently lubricated during its entire engine speed range, the mechanically-driven lubrication pump is generally sized so that it can supply the predetermined flow volume of lubrication fluid to the engine at peak torque engine speed. However, because the lubrication pump is operably coupled to the engine, as the engine speed increases above the peak torque engine speed, the output of the lubrication pump will also continue to increase. The lubrication pump will be producing more lubrication fluid than required to lubricate the engine. Therefore, in order to maintain the volume of lubrication fluid being delivery to the engine at the predetermined flow volume when the engine is operating at speeds greater than peak torque engine speed, the excess lubrication fluid is bypassed via a check valve within a bypass line back to a lubrication fluid source for re-circulation through the lubrication circuit.

Although sizing the lubrication pump such that it can produce the predetermined flow volume as soon as the engine reaches peak torque engine speed can assure that the engine is being adequately lubricated, it can also caused wasted power. It is known in the art that the engine speed at which the engine begins operating at peak torque is generally faster than idle, but often slower than speeds at which the engine predominately operates. For instance, an engine in an over the road truck may begin operating at peak torque at approximately 1100 rpms. However, the over the road truck spends the majority of its operating life on interstate highways going speeds at which the engine is operating at approximately 1500 rpm. Thus, the lubrication pump is producing excess lubrication fluid the majority of the over the road truck's operating life. Because the excess lubrication fluid is not used, but rather bypassed to the lubrication fluid source, the bypassed lubrication fluid represents wasted power. In other words, the engine horsepower consumed during the circulation of the unused lubrication oil is wasted, along with the consumed fuel. Thus, the majority of the engine's operating time, the lubrication pump is operating at least slightly inefficiently.

Further, because the lubrication pump is coupled to the engine, the lubrication pump cannot begin delivering lubrication fluid to the engine until after the engine has started. Although lubrication is critical at the instant of cranking, the lubrication fluid may remain in the lubrication fluid source rather than be delivered to the engine until after the lubrication pump can be sufficiently primed and powered by the engine.

One method of maintaining sufficient lubrication of an engine at engine start up and throughout the engine operating range is disclosed in U.S. Pat. No. 5,884,601, issued to Robinson, on Mar. 23, 1999. The Robinson lubrication system provides lubrication to an engine via a lubrication pump driven by a variable speed electric motor. The speed of the electric motor, and thus the lubrication pump, is independent of the engine speed. Thus, the lubrication pump can be activated, and provide lubrication fluid to the engine, upon ignition of the engine. Moreover, the electric motor is in electronic communication with an engine load sensor via a controller. Therefore, the speed of the electric motor driving the delivery of the lubrication pump can be varied based on the need for lubrication in the engine. The greater the engine load, the more lubrication fluid the lubrication pump can deliver. Thus, lubrication fluid need not be bypassed back to a lubrication fluid source.

Although the Robinson lubrication system can control the lubrication fluid volume independent of the engine speed by using the electric motor coupled to the lubrication pump, relying solely on an electrically-powered motor is less efficient and less reliable than relying on the mechanically-driven pump. Mechanically-driven pumps conserve energy and reduce operating costs being that they are driven directly off by the engine or through an efficient gear set. Moreover, mechanically-powered pumps have proven to be more reliable and durable than electrically-powered pumps. Further, because there is only one pump within the Robinson lubrication system, the pump must be sized to meet the highest and lowest demands of the engine, possibly increasing costs and decreasing efficiency.

The present invention is directed at overcoming one or more of the problems as set forth above.

SUMMARY OF THE INVENTION

In one aspect of the present invention, an engine includes an engine housing to which a lubrication circuit is attached. The lubrication circuit includes a lubrication pump that is operably coupled to the engine and a variable delivery pump. The variable delivery pump is in communication with a pump output controller that is operable to vary a lubrication fluid output from the variable delivery pump as a function of engine speed.

In another aspect of the present invention, a lubrication pump output controller includes an apparatus that is operably coupled to an electrically powered variable delivery pump. The apparatus includes an engine speed sensor and is operable to vary a lubrication fluid output from the variable delivery pump as a function of engine speed.

In yet another aspect of the present invention, a method of lubricating an engine includes a step of supplying a first amount of lubrication fluid to the engine via a lubrication pump operably coupled to the engine. A second amount of lubrication fluid is supplied to the engine via a variable delivery pump if the first amount of lubrication fluid is less than a predetermined lubrication fluid volume.

DETAILED DESCRIPTION

Figure 1:
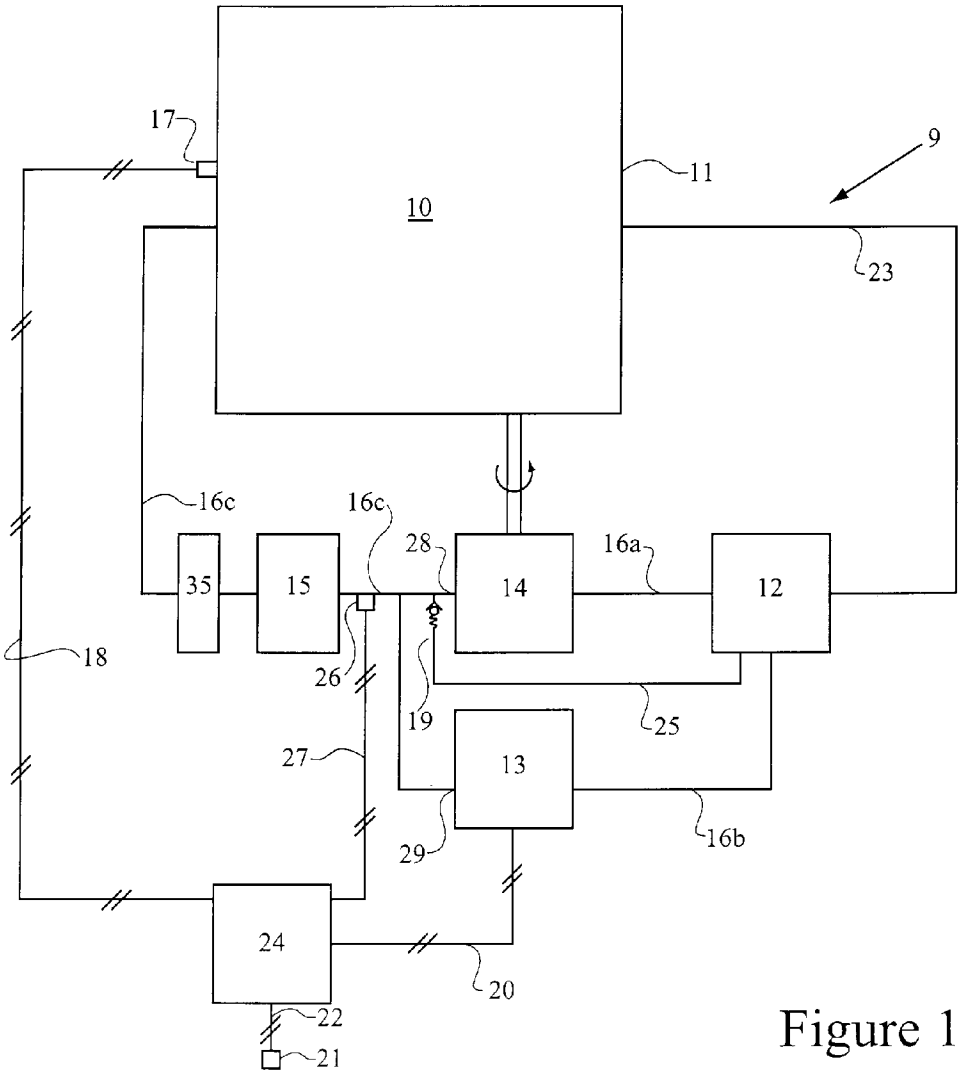
FIG. 1 is a schematic representation of an engine, according to the present invention.

Referring to FIG. 1, there is shown a schematic representation of an engine, according to the present invention. The engine 10 includes an engine housing 11 to which a lubrication circuit 9 is attached. The lubrication circuit 9 includes a lubrication pump 14 and a variable delivery pump 13. The lubrication pump 14 is operably coupled to the engine 10 via a conventional linkage that could include gears and rotating shafts. The variable delivery pump 13 is in communication with a pump output controller that is operable to vary a lubrication fluid output from the variable delivery pump 13 as a function of at least one of engine speed and lubrication flow volume. It should be appreciated that the lubrication flow volume is the volume of lubrication fluid being circulated through the lubrication circuit 9. Because the lubrication circuit 9 is a relatively closed system, the lubrication flow volume can be monitored by monitoring the pressure within the lubrication circuit 9. Although the output of the variable delivery pump 13 can be varied based on either lubrication flow volume or engine speed, it is preferred that the output of the variable delivery pump 13 be a function of both engine speed and lubrication flow volume (or pressure) or engine speed, alone. The variable delivery pump 13 is preferably an electrically-powered pump, but could be any type of variable delivery pump. The pump output controller is preferably an electronic control module 24 that includes a lubrication maintaining algorithm operable to vary the lubrication fluid output from the variable delivery pump 13 as a function of engine speed. Although the pump outlet controller is preferably the electronic control module 24, it should be appreciated that there could be various types of pump output controllers that can vary lubrication fluid output as a function of the engine speed, including mechanical pump output controllers.

The electronic control module 24 is in communication with the variable delivery pump 13 and an engine speed sensor 17 via a pump communication line 20 and an engine speed sensor communication line 18, respectively. The electronic control module 24 is also preferably in communication with a pressure sensor 26 and an ignition switch 21 via a pressure sensor communication line 27 and an ignition communication line 22, respectively. Although it is preferred that the present invention includes the pressure sensor 26 and the engine speed sensor 17 in order monitor the lubrication flow volume within the lubrication circuit 9, it should be appreciated that the lubrication flow volume within the lubrication circuit 9 could be estimated using other variables, such as with either the engine speed sensor 17 or the pressure sensor 26.

The lubrication pump 14 and the variable delivery pump 13 are positioned parallel to one another within the lubrication circuit 9. Thus, when both pumps 13 and 14 are activated, the lubrication pump 14 and the variable delivery pump 13 can simultaneously deliver lubrication fluid, such as oil, from a lubrication fluid source 12, preferably an oil pan, to the engine 10 via a supply line 16. The lubrication pump 14 draws lubrication fluid from the lubrication fluid source 12 via a first portion 16*a* of the supply line 16. The variable delivery pump 13 draws fluid from the lubrication fluid source 12 via a second portion 16*b* of the supply line 16. Both an outlet 28 of the lubrication pump 14 and an outlet 29 of the variable delivery pump 13 are fluidly connected to the third portion 16*c* of the supply line 16 in which an oil filter 15 and oil cooler 35 are preferably positioned. The second portion 16*b* of the supply line 16 can connect with the third portion of the supply line 16*c* in any conventional manner.

A bypass line 25 fluidly connects the lubrication fluid source 12 to the third portion 16*c* of the supply line 16 preferably at a point within the supply line 16 adjacent to the lubrication pump outlet 28 and upstream from the connection point between the second portion 16*b* and the third portion 16*c* of the supply line 16. The bypass line 25 includes a spring loaded bypass valve 19. When the flow volume being produced by the lubrication pump 14 exceeds a predetermined lubrication flow volume, the pressure created by the flow volume opens the spring loaded bypass valve 19. The lubrication fluid exceeding the predetermined lubrication flow volume can be returned to the lubrication fluid source 12 via the bypass line 25. The lubrication fluid not bypassed is delivered to the engine 10, along with the lubrication fluid produced by the variable delivery pump 13, and provides lubrication for the engine's moving parts, such as bearings on the crank shaft, and fluid to jets that spray the underside of pistons in order to cool engine. After being circulated through the engine 10, the lubrication fluid can be returned to the lubrication fluid source 12 for re-circulation via a return line 23. It should be appreciated that the present invention contemplates lubricants other than oil being circulated through the lubrication circuit 9.

Figure 2A:
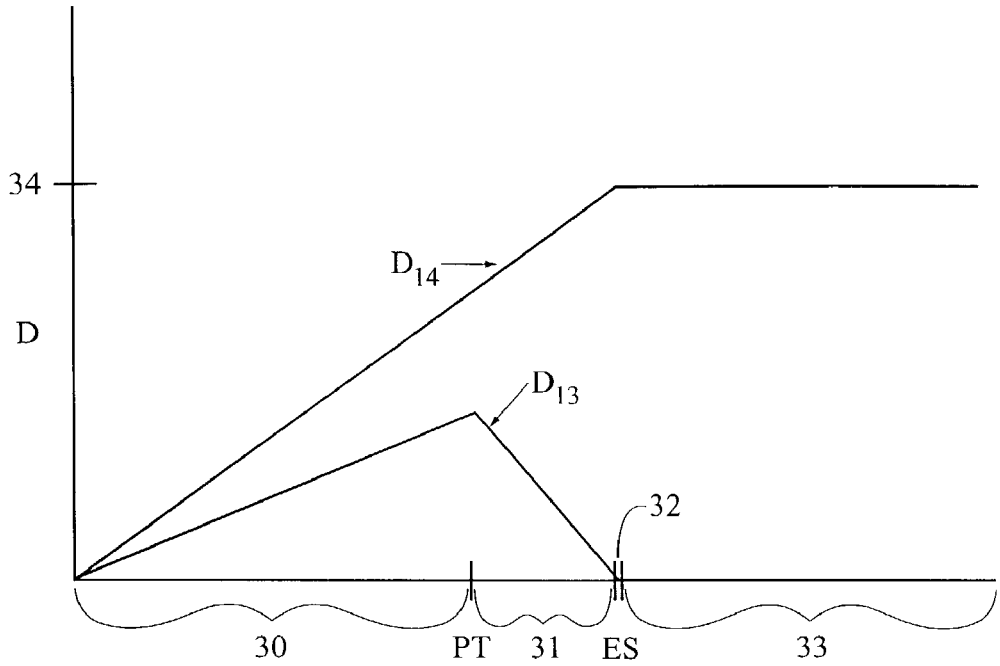
FIG. 2*a* is a graph illustrating a lubrication pump delivery and a variable delivery pump delivery versus engine speed, according to the present invention.
Figure 2B:
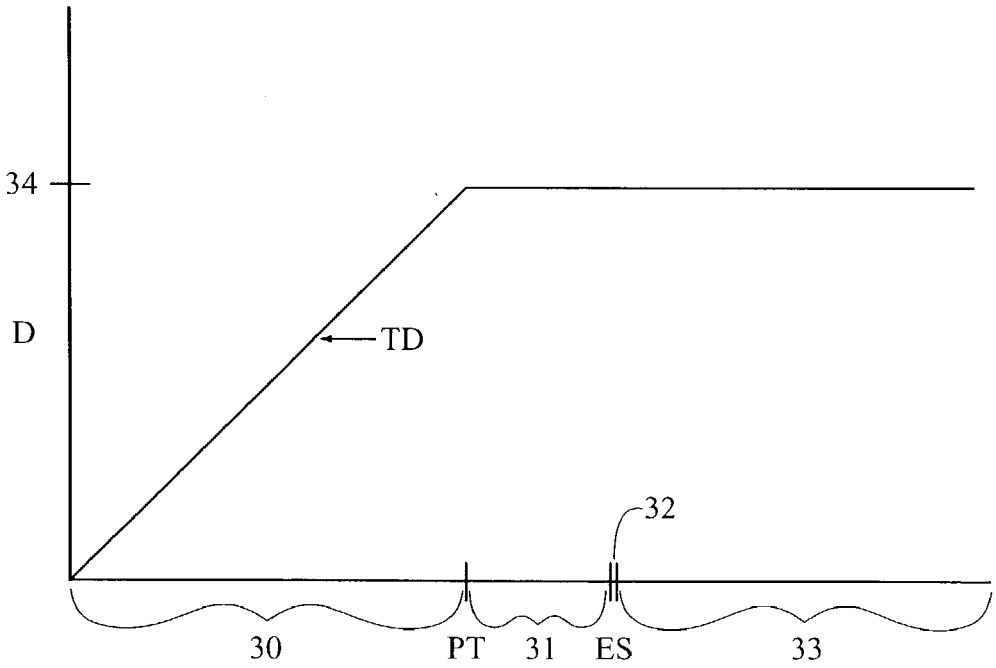
FIG. 2*b* is a graph illustrating a total lubrication fluid delivery versus engine speed, according to the present invention.

Referring to FIGS. 2*a* and 2*b*, there is shown a graph illustrating a lubrication pump delivery ($D_{14}$) and a variable delivery pump delivery ($D_{13}$) versus engine speed (ES), and a graph illustrating total lubrication fluid delivery (TD) versus engine speed (ES), respectively. Engine speed (ES) is illustrated along the x-axis of the each graph, and a lubrication fluid delivery (D) is illustrated along the y-axis of each graph. Along the x-axis, there is illustrated a peak torque engine speed (PT). The peak torque engine speed (PT) is the engine speed at which the engine 10 begins operating at peak torque. Those skilled in the art will appreciate that the torque on the engine will not increase even as the engine speed increases above the peak torque engine speed (PT). The variable delivery pump is preferably sized such that it delivers maximum output at the peak torque engine speed (PT). However, those skilled in the art will also appreciate that the variable delivery pump 13 can be sized to produce maximum output at an engine speed lower than peak torque engine speed in order to compensate for wear on the engine over time and sudden temperature changes. As an engine wears, the clearances between the engine's moving parts may increase, requiring more lubrication fluid. Further, if an engine 10 using lubrication fluid, such as oil, designed for use in cold temperatures is subjected to a warmer temperatures, the viscosity of the lubrication fluid may require more lubrication fluid to lubricate and cool the engine 10. For instance, in the illustrated example, the engine 10 is operating at peak torque at 1100 rpm. However, in order to compensate for possible engine wear, the variable delivery pump 13 could be sized to provide maximum output at 1000 rpm. Therefore, the engine 10 can be supplied with adequate lubrication fluid delivery under all expected conditions.

Along the y-axis, there is illustrated a predetermined lubrication flow volume 34 which is the flow volume of lubrication fluid required to maintain lubrication within and cool the moving parts of the engine 10 when the engine 10 is operating at and above the peak torque engine speed (PT). At engine speeds less than the peak torque engine speed (PT), the flow volume required to maintain lubrication within and cool the moving parts of the engine 10 increases with engine speed but remains less than the predetermined lubrication flow volume 34. It should be appreciated that the predetermined lubrication flow volume 34 can vary among different sizes and types of engines. It should further be appreciated that the predetermined lubrication flow volume 34 can be produced by the lubrication pump 14, the variable delivery pump 13, or both pumps 13 and 14. In order to assure that the predetermined lubrication flow volume 34 is maintained at speeds greater than peak torque engine speed (PT), the pressure sensor 26 positioned downstream from the lubrication pump outlet 29 and the variable delivery pump outlet 29 senses the pressure within the supply line 16, and communicates such to the electronic control module 24 via the pressure sensor communication line 27. Because the lubrication circuit 9 is a relatively closed system, the electronic control module 24 can determine the flow volume within the supply line 16 from the sensed pressure. Thus, the lubrication fluid being delivered to the engine 10 can be maintained at a predetermined pressure in order to maintain the delivery of the lubrication fluid at the predetermined lubrication flow volume 34.

Still referring to FIGS. 2*a* and 2*b*, the entire engine speed range of the engine 10 includes four subset ranges. There is preferably a low engine speed range 30, a middle engine speed range 31, a predetermined engine speed range 32, and a high engine speed range 33. The low engine speed range 30 extends from 0 rpms to the peak torque engine speed (PT). Those skilled in the art will appreciated that as the engine speed increases over the low engine speed range 30, the torque placed on the engine is also increasing. Thus, the flow volume of lubrication fluid required to lubricate and cool the engine 10 will increase with engine speed over the low engine speed range 30. However, because the engine is not yet operating at peak torque engine speed (PT), the volume of lubrication fluid that the engine requires remains less than the predetermined flow volume 34.

The middle engine speed range 31 includes engine speeds greater than the peak torque engine speed (PT) and less than a predetermined engine speed range 32. Because the middle engine speed range 31 only includes speeds over the peak torque engine speed (PT), the engine 10 requires the predetermined lubrication flow volume 34 in order to maintain lubrication over the middle engine speed range 31. The predetermined engine speed range 32 is the range of engine speeds at which the engine 10 predominately operates. Those skilled in the art will appreciate that the predetermined engine speed range 32 can be determined by analyzing a duty cycle of a vehicle in which the engine is operating. The duty cycle is a representation of how the vehicle is specifically used. In the illustrated example of the over the road truck, engineers determined from the duty cycle that the over the road truck spends most of its operating life at interstate speeds at which the engine is operating between 1500–1520 rpm. Thus, the predetermined engine speed range 32 is approximately 1500–1520 rpm for one example application. The lubrication pump 14 is sized such that it will produce the predetermined lubrication flow volume 34 at speeds within the predetermined engine speed range 32. The high engine speed range 33 includes engine speeds greater than the predetermined engine speed range 32. Because both the predetermined engine speed range 32 and the high engine speed range 33 only include speeds greater than the peak torque engine speed 34, the engine 10 will require the predetermined lubrication flow volume 34 in order to maintain lubrication over the predetermined engine speed range 32 and the high engine speed range 33.

Referring specifically to FIG. 2*a*, there is shown a graph illustrating the lubrication pump delivery ($D_{14}$) and the variable delivery pump delivery ($D_{13}$) versus engine speed (ES), according to the present invention. The lubrication pump delivery ($D_{14}$) illustrates the volume of lubrication fluid being delivered from the lubrication pump 14 to the engine 10, and the variable delivery pump delivery ($D_{13}$) illustrates the volume of lubrication fluid being delivered from the variable delivery pump 13 to the engine 10. Because the lubrication pump 14 is used as a primary lubrication pump and the variable delivery pump 13 is used as an auxiliary lubrication pump, the lubrication pump delivery ($D_{14}$) is significantly greater than the variable delivery pump delivery ($D_{13}$). Because the lubrication pump 14 is operably coupled to the engine 10, the lubrication pump delivery 14 increases with engine speed over the low engine speed range 30 and the middle engine speed range 31. Due to the size of the lubrication pump 14, when the engine 10 is operating at peak torque engine speed (PT), the lubrication pump delivery ($D_{14}$) is less than the predetermined lubrication flow volume 34. When the engine speed is within the predetermined engine speed range 32, the lubrication pump delivery ($D_{14}$) will approximately equal the predetermined lubrication flow volume 34. When the engine 10 operates within the high engine speed range 33, the lubrication pump delivery ($D_{14}$) will remain relatively constant at the predetermined lubrication flow volume 34. Within the high engine speed range 33, the pressure created by the lubrication pump delivery ($D_{14}$) exceeding the predetermined lubrication flow volume 34 will open the check valve 19. The excess flow volume will return to the lubrication fluid source 12 via the bypass line 25. The excess flow is at or near zero in range 32.

Referring specifically to the variable delivery pump delivery ($D_{13}$) illustrated in FIG. 2*a*, the variable delivery pump delivery ($D_{13}$) varies as a function of engine speed. The lubrication maintaining algorithm is preferably operable to increase the variable delivery pump delivery ($D_{13}$) as engine speed increases over the low engine speed range 30. The variable delivery pump 13 preferably produces maximum delivery at peak torque engine speed (PT). It should be appreciated that the variable delivery pump 13 can produce maximum output at an engine speed less than peak torque engine speed (PT) in order to assure sufficient lubrication flow as the engine wears. Further, it should be appreciated that the present invention contemplates the variable delivery pump delivery ($D_{13}$) being constant at its maximum delivery over the low engine speed range 30 rather than increasing to maximum delivery over the low engine speed range 30. The lubrication maintaining algorithm is preferably operable to decrease the variable delivery pump delivery ($D_{13}$) with increased engine speed over the middle engine speed range 31. If the engine speed increases to the predetermined engine speed range 32, the lubrication algorithm will preferably de-activate the variable delivery pump 13. The variable delivery pump 13 may remain inactive when the engine 10 is operating within the predetermined engine speed range 32 and the high engine speed range 33.

Referring to FIG. 2*b*, there is shown a graph illustrating a total lubrication fluid delivery (TD) versus engine speed (ES), according to the present invention. The total lubrication fluid delivery (TD) is the total volume of lubrication fluid being delivered to the engine 10. The total lubrication fluid delivery (TD) can be produced by the lubrication pump 14, the variable delivery pump 13, or both pumps 13 and 14 combined. It should be appreciated that the total lubrication fluid delivery (TD) is the volume of lubrication fluid needed to lubricate and cool the engine 10 at varying engine speeds. Over the low engine speed range 30, the need for lubrication fluid increases with engine speed because the engine 10 has not reached peak torque engine speed (PT). The total lubrication fluid delivery (TD) increases with increased engine speed because both the lubrication pump delivery ($D_{14}$) and the variable delivery pump delivery ($D_{13}$) increase with increased engine speed. Thus, over the low engine speed range 30, the total lubrication fluid delivery (TD) is the sum of both the lubrication pump delivery ($D_{14}$) and the variable pump delivery ($D_{13}$).

When the engine 10 reaches the peak torque engine speed (PT), the lubrication pump delivery ($D_{14}$) and the variable delivery pump delivery D 13 equal the predetermined lubrication flow volume 34. Over the middle engine speed range 31, the total lubrication fluid delivery (TD) remains relatively constant at the predetermined flow volume 34 as the engine speed increases because the lubrication pump delivery ($D_{14}$) continues to increase with increased engine speed while the variable delivery pump delivery ($D_{13}$) decreases with increased engine speed. The lubrication maintaining algorithm will decrease the variable delivery pump delivery ($D_{13}$) proportionately to the increase in the lubrication pump delivery ($D_{14}$).

Over the predetermined engine speed range 32, the total lubrication delivery (TD) also remains relatively constant at the predetermined lubrication flow volume 34. Because the lubrication pump delivery ($D_{14}$) is approximately equal to the predetermined lubrication flow volume 34 over the predetermined engine speed range, the lubrication maintaining algorithm will de-activate the variable delivery pump 13 when the engine speed is within the predetermined engine speed range 32. Thus, when the engine 10 is operating within the predetermined engine speed range 32, the total lubrication delivery (TD) is produced by the lubrication pump 14. The total lubrication delivery (TD) will remain relatively constant at the predetermined lubrication flow volume 34 over the high engine speed range 33. The variable delivery pump 13 will remain inactive within the high engine speed range 32. However, because the lubrication pump 14 is coupled to the engine 10, the production of lubrication fluid from the lubrication pump 14 will increase with engine speed. In order to maintain the predetermined lubrication flow volume 34 over the high engine speed range 33, lubrication fluid in excess of the predetermined lubrication flow volume 34 will be bypassed via the bypass line 25 back to the lubrication fluid source 12.

It should be appreciated that the lubrication maintaining algorithm preferably is also operable to activate the variable delivery pump 13 when the engine 10 is inactive. When the ignition switch 21 is activated and such is communicated to the electronic control module 24 via the ignition communication line 22, the electronic control module 24 can activate the variable delivery pump 13 via the pump communication line 20. Once the electronic control module 24 determines that the engine has been significantly lubricated by either monitoring the time period which the variable delivery pump 13 has been activated or the lubrication pressure within the engine 10, the engine 10 can begin cranking. Therefore, upon engine cranking, it is assured that the engine 10 will be lubricated.

Industrial Applicability

Referring to FIGS. 1–2, the present invention will be described for an over the road truck that includes the predetermined engine speed range 32. In the illustrated example, the predetermined engine speed range 32 is approximately 1500–1520 rpm. Thus, the engine 10 within the over the road truck spends the majority of its operating time at approximately 1500–1520 rpm. However, it should be appreciated that the present invention could apply to over the road trucks having predetermined engine speed ranges different than 1500–1520 rpm. Moreover, the present invention can apply to other types of applications having different predetermined engine speed ranges, such as an off road work machine or generator set.

In order to determine the predetermined engine speed range 32, a duty cycle of the vehicle may be considered. Those skilled in the art will appreciate that the duty cycle of the vehicle is a representation of how the vehicle is specifically used. For instance, although the over the road truck spends some operating time on city roads at relatively low speeds, the over the road truck predominately operates at relatively high speeds on the interstate. When operating on the interstate, the illustrated over the road truck spends most of its time within a range of vehicle speeds. The predetermined engine speed range 32 is the range of engine speeds at which the engine operates when the vehicle is operating within it's predominate range of vehicle speeds. Once the predetermined engine speed range 32 is determined, the lubrication pump 14 can be sized to produce the predetermined flow volume 34 within the predetermined engine speed range 32. Those skilled in the art will appreciate that the lubrication pump 14 can be sized in any conventional manner, including but not limited to, altering a distance of a piston stroke.

Further, the present invention is illustrated as a method for lubricating the engine 10 using a closed loop system including the engine speed sensor 17 and the pressure sensor 26.

The lubrication maintaining algorithm will vary the variable delivery pump delivery ($D_{13}$) as a function of the sensed engine speed in order to supplement the lubrication pump delivery ($D_{14}$) and supply the total delivery (TD) required to lubricate the engine 10. The pressure sensor 26 can sense the pressure and communicate the sensed pressure to the electronic control module 24 to determine whether the total lubrication fluid delivery (TD) is equal to the predetermined lubrication flow volume 34. Although the present invention includes both the pressure sensor 27 and the engine speed sensor 17, it should be appreciated that the lubrication of the engine 10 could be maintained simply by sensing only one of the pressure and the engine speed, or by sensing other circuit conditions. Moreover, although the electronic control module 24 is the preferred pump output controller, the variable delivery pump delivery ($D_{13}$) could be varied as a function of engine speed by various types of pump output controllers, such as mechanical pump output controllers.

In order to initiate engine start-up, the ignition switch 21 will be activated. The activation of the ignition switch 21 will be communicated to the electronic control module 24 via the ignition communication line 22. Upon the ignition switch 21 being activated and prior to engine cranking, the lubrication maintaining algorithm preferably will activate the variable delivery pump 13 to produce some predetermined output via the pump communication line 20. The variable delivery pump 13 will supply lubrication fluid to the engine 10 via the supply line 16 in order to assure the engine 10 is lubricated when engine cranking begins. Because engine wear often occurs during engine cranking, it is important that the engine 10 be sufficiently lubricated prior to cranking. It should be appreciated that the present invention contemplates various methods for determining the time period the variable delivery pump 13 is to be activated prior to engine cranking. For instance, the present invention contemplates an open loop system in which the variable delivery pump 13 will remain active prior to engine cranking for a predetermined time period, or a closed loop system in which the variable delivery pump 13 will remain activated until a pressure sensor can sense and the electronic control module 24 can determine that the pressure within the lubrication circuit 9 is sufficient to prevent substantial wear during engine cranking.

After startup, the lubrication pump 14 will slowly begin to operate. As the engine speed increases, the lubrication pump 14 will be able to draw more lubrication fluid from the lubrication fluid source 12 and deliver the lubrication fluid to the engine 10. After engine 10 starts, the engine speed sensor 17 will periodically sense the engine speed and communication such to the electronic control module 24 via the sensor communication line 18. The lubrication maintaining algorithm will determine the variable delivery pump delivery ($D_{13}$) needed to supplement the lubrication pump delivery ($D_{14}$) at the sensed engine speed. The electronic control module 24 will supply the variable delivery pump 13 will sufficient current to produce the variable delivery pump delivery ($D_{13}$) needed at the sensed engine speed. The engine speed sensor 17 will continue to sense and communication the engine speed to electronic control module 24, and the lubricating maintaining algorithm will continue to determine the variable delivery pump delivery ($D_{13}$) needed to supplement to the lubrication pump delivery ($D_{13}$). As the sensed engine speed increases over the low engine speed range 30, the lubrication maintaining algorithm will increase the variable delivery pump delivery ($D_{13}$) and the engine 10 will increase the lubrication pump delivery ($D_{14}$). Thus, as engine speed increases over the low engine speed range 30, the total lubrication fluid delivery (TD) also increases to satisfy the lubrication demands of the engine.

Those skilled in the art will appreciate that when the engine has increased to speeds at or above the peak torque engine speed (PT), the total lubrication fluid delivery (TD) required to lubricate and cool the engine 10 remains relatively constant at the predetermined lubrication flow volume 34 regardless of engine speed increase. As the engine speed increases over the middle engine speed range 31, the lubrication pump 14 will increase its delivery ($D_{14}$) to the engine 10 via the third portion 16*c* of the supply line 16. In order to maintain the third portion 16*c* of the supply line 16 at the predetermined lubrication flow volume 34, the lubrication maintaining algorithm will continue to monitor the sensed engine speed. The lubrication maintaining algorithm will decrease the electric current to the variable delivery pump 13 via the pump communication line 20 as the sensed engine speed increases. The variable delivery pump delivery ($D_{13}$) will preferably decrease over the middle engine speed range 31 at a rate that maintains the total lubrication fluid delivery (TD) at the predetermined lubrication flow volume 34. The pressure sensor 26 can periodically sense the pressure within the third portion 16*c* of the supply line 16 in order to assure that the predetermined lubrication flow volume 34 is maintained. If the pressure within the third portion 16*c* of the supply line 16 falls below the pressure corresponding with the predetermined flow volume 34, the lubrication maintaining algorithm could adjust the variable delivery pump delivery ($D_{13}$) accordingly.

As the vehicle increases in speed, the engine sensor 17 may sense, and the lubrication maintaining algorithm may determine, that the engine 10 is operating at a speed within the predetermined engine speed range 32. The pressure sensor 26 will also sense the pressure within the third portion 16*c* of the supply line 16 and communicate such to the electronic control module 24. The lubrication maintaining algorithm should determine that the pressure within the supply line 16 correlates to the predetermined flow volume 34. Once the lubrication maintaining algorithm determines that the sensed engine speed is within the predetermined engine speed range 32 and the pressure within the third portion 16*c* of the supply line 16 correlates to the predetermined lubrication flow volume 34, the lubrication maintaining algorithm will de-activate the variable delivery pump 13 by stopping the supply of electric current to the variable delivery pump 13. However, at speeds within the predetermined engine speed range 32, the lubrication pump 14 is being sufficiently driven by the engine 10 in order to supply the total lubrication fluid delivery (TD) to the engine 10 without the aid of the variable delivery pump 13. Because the predetermined engine speed range 32 was determined to be the engine speeds at which the engine predominately operates, the engine 10 will preferably spend a majority of its operating time within the predetermined engine speed range 32. Thus, the majority of the engine operating time, the variable delivery pump 13 is inactive and there is no lubrication fluid being bypassed back to the lubrication fluid source 12.

If the lubrication maintaining algorithm determines that the engine speed is continuing to increase above the predetermined engine speed range 32 and into the high engine speed range 33, the lubrication maintaining algorithm will maintain the total lubrication fluid delivery (TD) to the engine 10 at the predetermined lubrication flow volume 34.

Although the increased engine speeds will drive the lubrication pump 14 to produce a flow volume of lubrication fluid greater than the predetermined lubrication flow volume 34, the excess volume flowing from outlet 29 will act as pressure on the spring loaded valve 19 within the bypass line 25, causing the valve 19 to open against the bias of the spring. The excess volume of lubrication fluid in excess of the predetermined flow volume 32 will return to the lubrication fluid source 12. If the engine speed drops back within the predetermined engine speed range 32, the pressure within the third portion 16*c* of the supply line 16 should again equal the predetermined lubrication flow volume 34, allowing the valve 19 to close and block the bypass line 25 from the third portion 16*c* of the supply line 16. The variable delivery pump 13 may remain inactive at engine speeds within the predetermined engine speed range 32 and the high engine speed range 33. In order to shut down the engine 10, the ignition switch 21 will be de-activated. The de-activation of the ignition switch 21 can be communicated to the electronic control module 24 via the ignition communication line 22. Upon the de-activation of the ignition switch 21, the lubrication maintaining algorithm preferably will activate the variable delivery pump 13 to produce some predetermined output via the pump communication line 20. The variable delivery pump 13 can supply cooling lubrication fluid to certain components, such as a turbocharger, to reduce the occurrence of problems associated with heat soaking.

The present invention is advantageous because it can sufficiently lubricate and cool the engine 10 over the entire engine speed range while improving fuel efficiency. The lubrication pump 14 that is operably coupled to the engine 10 can be sized to produce the predetermined lubrication flow volume 34 at engine speeds at which the engine 10 predominately operates. Thus, during the majority of engine operating time, the lubrication pump 14, alone, can lubricate the engine 10 while not bypassing fluid back to the lubrication fluid source 12. Therefore, the amount of bypassed lubrication fluid, and thus wasted power, can be reduced. At the predominate engine speeds, the engine 10 is not powering the lubrication pump 14 any more than necessary, resulting in decreased fuel consumption. The energy used by the variable delivery pump 13 to supplement the lubrication pump 14 at lower engine speeds is less than the energy saved by limiting the bypassed lubrication fluids. Further, the present invention allows the engine 10 to be sufficiently lubricated while still benefiting from the reliability and efficiency of a mechanically-driven primary lubrication pump 14.

Moreover, the present invention is advantageous because the electrically-powered variable delivery pump 13 can be activated prior to engine cranking in order to assure that the engine 10 is sufficiently lubricated during engine cranking. Thus, the risk of engine wear during engine cranking is reduced.

Furthermore, the present invention is advantageous because the electrically-powered variable delivery pump 13 can be activated following engine shutdown in order to provide a cooling oil flow to a turbocharger, thus reducing the occurrence of problems associated with heat soaking.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. An engine comprising:

an engine housing;

a lubrication circuit attached to the engine housing and including a variable delivery pump and a lubrication pump;

the lubrication pump being operably coupled to an engine to produce a lubrication fluid output rate that is less than an adequate engine lubrication flow rate at a peak torque engine speed; and the variable delivery pump being in communication with a pump output controller operable to vary a lubrication fluid output from the variable delivery pump among a plurality of positive output flow rate over an engine speed range.

2. The engine of claim 1 wherein the variable delivery pump being electrically powered;

said pump output controller being operable to vary output from said variable delivery pump as a function of at least one of engine speed and lubrication circuit pressure, and the function includes a continuous range of output flow rates; and the continuous range increases with engine speed below the peak torque engine speed, and decreases with engine speed over a speed range above the peak torque engine speed.

3. The engine of claim 2 wherein the pump output controller being operable to power the variable delivery pump when the engine is inactive, and the outputs of said lubrication pump and said variable delivery pump are cumulative.

4. The engine of claim 1 wherein the pump output controller includes an electronic control module with a lubrication maintaining algorithm operable to set a combined output from said lubrication pump and said variable delivery pump to satisfy active engine lubrication requirements over a plurality of engine operating conditions; and the lubrication maintaining algorithm is operable to deactivate the variable delivery pump in a predetermined engine speed range that is less than a high speed range.

5. The engine of claim 4 including at least one of an engine speed sensor and a lubrication circuit pressure sensor in communication with the electronic control module.

6. The engine of claim 5 wherein the predetermined engine speed range is greater than a low speed range;

the variable delivery pump is electrically powered and its output is cumulative with that of said lubrication pump; and the pump output controller being operable to power the variable delivery pump when the engine is inactive.

7. A lubrication pump output controller comprising:

an apparatus operably coupled to a variable delivery pump and including at least one of an engine speed sensor and a lubrication circuit pressure sensor;

the variable delivery pump being electrically powered; and the apparatus being operable to vary a lubrication fluid output from the variable delivery pump among a plurality of positive output flow rates as a function of a peak torque engine speed and at least one of engine speed and lubrication circuit pressure.

8. The pump outlet controller of claim 7 including an electronic control module with a lubrication maintaining algorithm operable to set a combined output from said lubrication pump and said variable delivery pump to satisfy active engine lubrication requirements over a plurality of engine operating conditions.

9. The pump outlet controller of claim 8 wherein the lubrication maintaining algorithm being operable to de-activate the variable delivery pump when at least one of the sensed engine speed is within a predetermined engine speed range and the sensed pressure is above a predetermined pressure corresponding to adequate lubrication pump output.

10. The pump outlet controller of claim 9 wherein the lubrication maintaining algorithm being operable to provide a predetermined lubrication flow volume when the sensed engine speed is less than the predetermined engine speed range, the predetermined lubrication flow volume continuously increasing output from the variable delivery pump with engine speed over a low engine speed range and decreasing with engine speed over a middle engine speed range.

11. The pump output controller of claim 9 including at least one pressure sensor being positioned downstream from an outlet of the variable delivery pump and an outlet of a lubrication pump operably coupled to the engine and being in communication with the electronic control module.

12. A method of lubricating an engine comprising the steps of:

supplying a first amount of lubrication fluid to the engine via a lubrication pump operably coupled to the engine, and the first amount being less than a predetermined lubrication flow volume at a peak torque engine speed;

supplying a second amount of lubrication fluid to the engine via a variable delivery pump if the first amount of lubrication fluid is less than the predetermined lubrication flow volume, and the second amount of fluid being one of a plurality of positive output flow rates over an engine speed range; and the predetermined lubrication flow volume corresponding to an adequate lubrication flow rate at each engine speed.

13. The method of claim 12 wherein the step of supplying the second amount of lubrication fluid includes a step of determining if the first amount of lubrication fluid is less than the predetermined lubrication flow volume, at least in part, by sensing at least one of engine speed and lubrication circuit pressure.

14. The method of claim 13 wherein the step of determining includes a step of sensing pressure downstream from an outlet of the lubrication pump and an outlet of the variable delivery pump.

15. The method of claim 13 wherein the step of supplying the second amount of lubrication fluid includes a step of continuously increasing the supply of the second amount of lubrication fluid as the sensed engine speed increases over a low engine speed range.

16. The method of claim 13 wherein the step of supplying the second amount of lubrication fluid includes a step of continuously decreasing the second amount of the lubrication fluid as the sensed engine speed increases over a middle engine speed range.

17. The method of claim 13 wherein the step of supplying the second amount of lubrication fluid includes a step of de-activating the variable delivery pump when the sensed engine speed is within a predetermined engine speed range corresponding to predominant engine speeds for a predetermined duty cycle.

18. The method of claim 12 wherein the step of supplying the second amount includes a step of electrically powering the variable delivery pump;

de-activating an engine ignition switch to shut down the engine; and activating the variable delivery pump upon engine shut down.

19. The method of claim 18 including a step of priming a lubrication circuit of the engine, at least in part, by activating the variable delivery pump when the engine is inactive.

20. An engine comprising:

an engine housing;

a lubrication circuit attached to the engine housing and including a variable delivery pump and a lubrication pump;

the lubrication pump being operably coupled to an engine to produce a lubrication fluid output rate that is less than an adequate engine lubrication flow rate at a peak torque engine speed;

the variable delivery pump being in communication with a pump output controller operable to vary a lubrication fluid output from the variable delivery pump;

the pump output controller being operable to deactivate the variable delivery pump over a predetermined engine speed range that is greater than the peak torque engine speed, but less than a high speed range; and the predetermined engine speed range including predominant engine speeds for a predetermined duty cycle.

* * * * *